United States Patent [19]

Wood

[11] Patent Number: 4,788,955

[45] Date of Patent: Dec. 6, 1988

[54] APPARATUS FOR SPARK ADVANCE THROTTLE CONTROL

[75] Inventor: Le Roy T. Wood, Racine, Wis.

[73] Assignee: Outboard Marine Corporation, Waukegan, Ill.

[21] Appl. No.: 98,729

[22] Filed: Sep. 16, 1987

Related U.S. Application Data

[63] Continuation of Ser. No. 946,759, Dec. 29, 1986, abandoned.

[51] Int. Cl.[4] ..... F02P 5/02

[52] U.S. Cl. ..... 123/413; 74/470; 74/582; 123/400

[58] Field of Search ..... 123/376, 396, 398, 400, 123/413; 74/470, 513, 516, 526, 582

[56] References Cited

U.S. PATENT DOCUMENTS

| | | | |
|---|---|---|---|
| 2,575,901 | 11/1951 | Wheeler | 74/470 X |
| 2,890,689 | 6/1959 | Alexander | 74/470 X |
| 2,906,251 | 9/1959 | Soder, Jr. | 123/413 |
| 2,914,960 | 12/1959 | Edgerton | 74/526 |
| 3,604,404 | 9/1971 | Pitchford | 74/470 X |
| 4,443,388 | 4/1984 | Teramura et al. | 261/39 |
| 4,462,268 | 7/1984 | Boeger | 74/519 |
| 4,476,068 | 10/1984 | Griffin et al. | 261/65 |
| 4,528,954 | 7/1985 | Slattery | 123/413 |
| 4,566,415 | 1/1986 | Iwai et al. | 123/413 X |

*Primary Examiner*—Tony M. Argenbright

*Attorney, Agent, or Firm*—Michael, Best & Friedrich

[57] ABSTRACT

Disclosed herein is a throttle control assembly for positioning the throttle valve of an internal combustion engine of the type including a cam movable in accordance with desired engine speed changes, the throttle control assembly comprising a mechanism coupled to the throttle valve and including a member coupled to the cam for opening the throttle valve in response to movement of the member in a first direction and for closing the throttle valve in response to movement of the member in a second direction, and a relative movement mechanism for preventing continued opening of the throttle valve beyond a predetermined position despite continued movement of the member in the first direction.

21 Claims, 1 Drawing Sheet

APPARATUS FOR SPARK ADVANCE THROTTLE CONTROL

This application is a continuation of Ser. No. 946,759 filed Dec. 29, 1986, abandoned.

BACKGROUND OF THE INVENTION

This invention relates generally to internal combustion engines and, more particularly, to a throttle control assembly for use in an internal combustion engine having spark advance speed control.

In the engine art, it is common to vary the speed of a 2-cycle internal combustion engine through direct variation of engine ignition timing and indirect variation of throttle valve position. Typically, a rotatable cam is moved in accordance with desired engine speed changes and a cam follower, engaging the cam, is coupled to the throttle valve to adjust throttle valve position in accordance with the degree of cam rotation. However, due to practical manufacturing tolerances as well as shrinkage problems when the cam and cam follower are manufactured of economical plastic, the maintenance of a wide-open throttle valve position at high engine speeds has been difficult to achieve with consistency. Over-center operation of the throttle valve, i.e. operation of the throttle valve so that it rotates to and then beyond the wide-open position, sometimes results. This, in turn, causes engine deceleration and reduced overall engine performance.

One technique for avoiding over-center operation of a throttle valve includes splitting the throttle cam and providing an adjustment screw on the cam itself to permit adjustment of the cam profile, i.e., the radial length between the camming surface of the cam and the center of rotation of the cam. Another known technique includes providing the cam follower with a similar adjustment mechanism so as to permit adjustment of the cam follower length. Sometimes it is necessary to combine both techniques in order to provide cam follower contact at the proper cam pick-up point and to assure proper correlation of throttle valve position with engine ignition timing. However, these prior techniques do not assure that over-center operation of the throttle valve will not occur.

Attention is directed to the following U.S. Patents:

Griffin et al.; U.S. Pat. No. 4,476,068 Oct. 9, 1984

Boeger; U.S. Pat. No. 4,462,268 July 31, 1984

Teramura et al.; U.S. Pat. No. 4,443,388 Apr. 17, 1984

SUMMARY OF THE INVENTION

The invention provides an engine apparatus comprising an internal combustion engine, a cam movable in response to desired engine speed changes, a throttle valve movable between a closed position and an open position for regulating the flow of combustion air to the engine, and a throttle control assembly responsive to movement of the cam for controlling the position of the throttle valve in accordance with the desired engine speed changes, the throttle control assembly comprising a cam follower for engaging the cam, a cam follower slide supporting the cam follower, a cam follower slide ramp having means on the slide ramp for supporting the cam follower slide in position for engagement of the cam follower with the cam and for movement of the cam follower slide along a predetermined path in response to movement of the cam follower incident to movement of the cam, a linkage assembly coupling the cam follower slide with the throttle value so as to vary the position of the throttle valve in accordance with the position of the cam follower slide along the predetermined path, a throttle stop for preventing movement of the cam follower slide in one direction along the predetermined path beyond a position corresponding to the open position of the throttle valve, and means for providing relative movement between the cam follower and the cam follower slide when the cam follower slide is in the position and the cam causes continued movement in the one direction of the cam follower, whereby movement of the throttle valve beyond the open position is prevented despite continued movement of the cam in accordance with further desired change in engine speed.

In one embodiment the cam follower is slidably mounted on the cam follower slide and the relative movement means includes a spring biasing the cam follower toward the cam.

In one embodiment, the relative movement means includes means for adjustably limiting movement of the cam follower relative to the cam follower slide in the direction opposite the one direction. This permits adjustment of throttle valve position at low engine speeds.

In one embodiment a throttle return spring is provided for biasing the throttle valve toward the closed position such that the cam follower is continuously biased against the cam.

In one embodiment, the bias force developed by the throttle return spring is less than the bias force developed by the cam follower spring. Thus, movement of the cam so as to open the throttle valve causes the throttle return spring to become compressed while the cam follower spring remains substantially uncompressed. However, when the throttle stop prevents further movement of the cam follower slide and the cam urges continued movement of the cam follower, the cam follower spring compresses to permit further movement of the cam follower without further opening of the throttle valve.

The invention also provides a throttle control assembly for positioning the throttle valve of an internal combustion engine of the type including a cam movable in accordance with desired engine speed changes, the throttle control assembly comprising means coupled to the throttle valve and including a member engaging the cam for opening the throttle valve in response to movement of the member in a first direction and for closing the throttle valve in response to movement of the member in a second direction, and lost movement means for preventing continued opening of the throttle valve beyond a predetermined position despite continued movement of the member in the first direction.

The invention also provides a throttle control assembly for positioning the throttle valve of an internal combustion engine of the type including a cam movable in accordance with desired engine speed changes, the throttle control assembly comprising means adapted for coupling to the throttle valve and including apparatus having first and second members and being adapted for coupling to the cam for opening the throttle valve in response to movement of the apparatus in a first direction and for closing the throttle valve in response to movement of the apparatus in a second direction, and relative movement means for preventing continued movement of the apparatus in the first direction beyond a predetermined position despite continued movement of the first member in the first direction.

Various other principal features of the invention will become apparent to those skilled in the art upon review of the following detailed description, claims and drawings.

Figure 1:
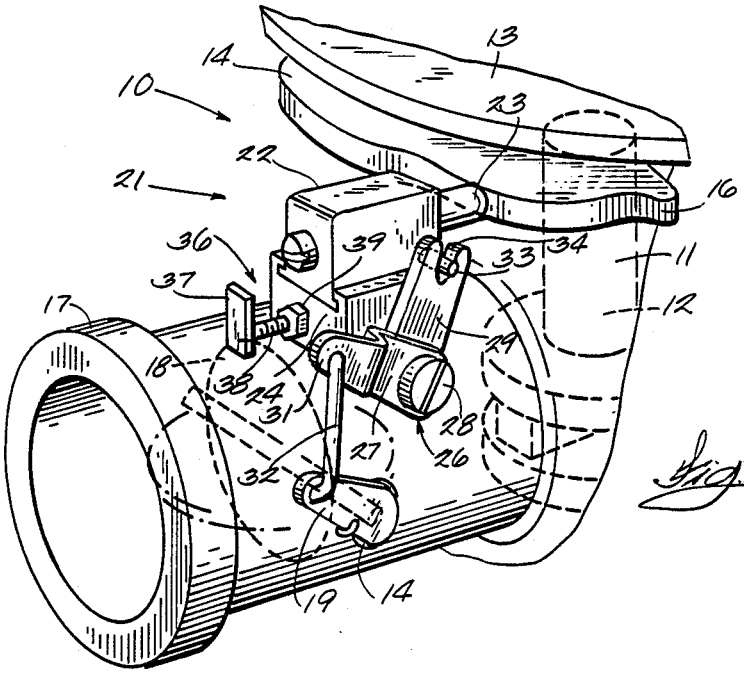
FIG. 1 is a perspective view of an engine apparatus embodying the invention.
Figure 2:
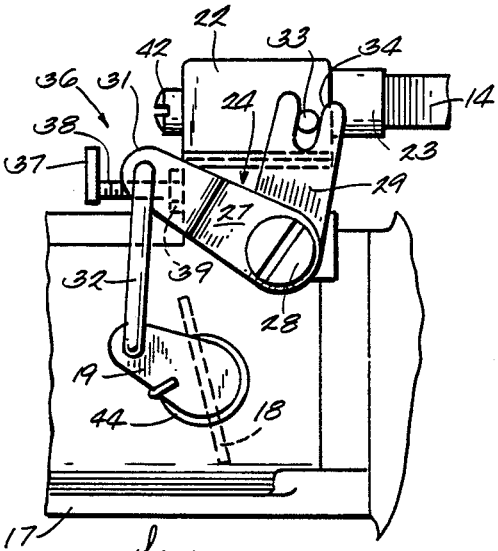
FIG. 2 is a side-elevational view of the engine apparatus showing a throttle valve in a substantially fully closed position.

Before one embodiment of the invention is explained in detail, it is to be understood that the invention is not limited in its application to the details of construction and the arrangements of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

An engine apparatus 10 embodying the invention is illustrated in the drawings. The engine apparatus 10 comprises an internal combustion engine 11 including a crankshaft 12, a timer plate 13, and a throttle controlling cam 14 mounted on the timer plate 13 for common movement therewith. In accordance with known techniques, the rotational position of the timer plate 13 is varied so as to advance or retard engine ignition timing and thereby vary engine speed. In further accordance with known techniques, the position of the throttle controlling cam 14 varies in accordance with the desired engine speed changes.

The throttle controlling cam 14 has a cam surface 16 and includes a portion of rapidly increasing radius and a portion which is nearly concentric with the axis of the crankshaft 12. As viewed in FIG. 1, the timer plate 13 is rotated counterclockwise around a center of rotation fixed by the axis of the crankshaft 12 to advance the spark timing and is rotated clockwise to retard spark timing. The throttle controlling cam 14 rotates along with the timer plate 13.

The engine apparatus 10 also includes a carburetor 17 mounted on the engine 11 and further includes a throttle valve 18, movable between maximum open (wide-open) and maximum closed (idle) positions, for controlling the flow of combustion air to the engine 12. A pivotal actuating lever 19 is operably connected to the throttle valve 19. Pivotal movement of the actuating lever 21 controls opening and closing of the throttle valve 19.

A similar arrangement is disclosed in Soder, U.S. Pat. No. 2,906,251, issued Sept. 29, 1959, which is herein incorporated by reference.

The engine apparatus 10 also includes a throttle control assembly 21 for positioning the throttle valve 18 in accordance with the desired engine speed changes. The throttle control assembly 21 includes means, including a member engaging the throttle controlling cam 14, coupled to the throttle valve 18 for opening the throttle valve 18 in response to movement of the member in a first direction and for closing the throttle valve 18 in response to movement of the member in a second direction. While various suitable means can be used, in the preferred embodiment, the means includes a cam follower slide 22 supporting a cam follower 23 for common movement and for movement relative thereto. The means further includes a cam follower slide ramp or support 24 for positioning the cam follower slide 22 such that the cam follower 23 engages the cam surface 16 of the throttle controlling cam 14 and such that movement of the cam follower 23 in response to movement of the cam 14 is translated into movement of the cam follower slide 22 along a predetermined path. In the embodiment illustrated in FIG. 1, the predetermined path comprises a linear horizontal path aligned substantially radially with respect to the center of rotation of the timer plate 13 and the throttle controlling cam 14.

The means coupled to the throttle valve further includes a linkage assembly 26 coupling the cam follower slide 22 with the throttle valve 18 so as to vary the position of the throttle valve in accordance with the position of the cam follower slide 22 along the predetermined path. In the embodiment illustrated, the linkage assembly includes a bell crank 27 mounted to the side of the cam follower slide ramp 24 for movement around a pivot 28, and having a pair of angularly spaced bell crank arms 29 and 31. A connecting link 32 interconnects the bell crank arm 31 with the throttle valve actuating lever 19, while a horizontally disposed pin 33, projecting from the side of the cam follower slide 22, is received in a notch 34 formed in the end of the bell crank arm 29. When so connected, movement of the cam follower slide 22 results in rotation of the bell crank 27 around its pivot 28 with the further result that the actuating lever 19 is moved to rotate the throttle valve 18 between the open and closed positions.

The throttle control assembly further comprises lost or relative movement means for preventing continued opening of the throttle valve 18 beyond a predetermined position despite continued movement of the member (cam follower slide 22) in the first direction. While various suitable means can be used, in the preferred embodiment, the relative movement means includes a throttle stop 36 for preventing movement of the cam follower slide 22 along the predetermined path beyond a fixed stop position corresponding to a desired limit position of the throttle valve 18.

In the embodiment illustrated, the throttle stop comprises an elongate rigid plate 37 mounted to an end of a threaded shaft 38. The opposite end of the shaft 38 is received in the end of the cam follower slide ramp 24 so that the plate 37 is aligned with the cam follower slide 22. To permit adjustment of the fixed stop position, a jam nut 39 is positioned on the threaded shaft 38 and functions to permit the stop plate 37 to be locked at various desired spacings behind the cam follower slide ramp 24. When the rear surface of the cam follower slide 22 engages the stop plate 37, further movement of the cam follower slide 22 along the predtermined path is prevented.

The relative movement means also comprises a lost or relative movement assembly for permitting relative movement between the cam follower 23 and the cam follower slide 22 when the cam follower slide 22 is in the fixed stop position established by the throttle stop 36 and the throttle controlling cam 14 urges continued movement of the cam follower slide 22 along the predetermined path.

In the preferred embodiment, the relative movement assembly includes the cam follower slide 22 and the cam follower 23 and further includes means for permitting relative movement between the cam follower 23 and the cam follower slide 22. To this end, the cam follower 23 is slidably mounted to the cam follower slide 22 for inward and outward movement relative to the cam follower slide. As illustrated, the cam follower slide 22 includes a hollow interior, and the cam follower 23 is telescopingly received in the hollow interior of the cam follower slide.

Figure 4:
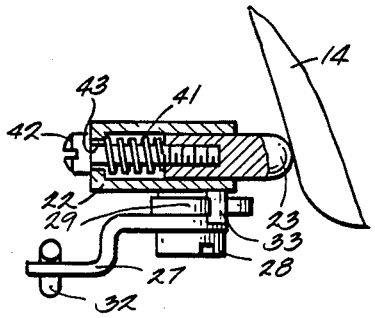
FIG. 4 is a top plan view, partially in section, of a throttle control assembly embodying one aspect of the invention.

In order to assure that the cam follower 23 bears against the cam surface 16 of the throttle controlling cam 14 during engine operation, the relative movement means further includes a cam follower bias spring for biasing the cam follower 23 outwardly relative to the cam follower slide 22. As best illustrated in FIG. 4, the cam follower spring 41 is disposed within the hollow interior of the cam follower slide 22 substantially behind the end of the cam follower opposite the end bearing against the throttle controlling cam 14. Ordinarily, the cam follower spring 41 is partially compressed so as to outwardly bias the cam follower 23 relative to the cam follower slide 22.

To limit the maximum outward movement of the cam follower relative to the cam follower slide, adjusting means, in the form of a threaded adjustment screw 42, is provided. The adjustment screw 42 extends into the interior of the cam follower slide 22 through an aperture 43 formed in the rear wall of the cam follower slide and threadedly engages the cam follower 23. Maximum separation of the cam follower 23 and the cam follower slide 22 is limited by the head of the adjusting screw 42 coming into contact with the rear surface of the cam follower slide. By virtue of the partial compression of the cam follower spring 41, the cam follower 23 is ordinarily biased to the maximum separation position during ordinary engine operation.

In accordance with normal practice, the internal combustion engine 11 is provided with a throttle return spring 44 engaging the throttle valve actuating lever 19 so as to bias the throttle valve 18 toward the fully closed position. Thus, in the absence of any force on the throttle valve actuating lever 19 tending to oppose the bias of the throttle return spring 44, the throttle valve 18 will be biased into the fully closed position. To assure that movement of the cam follower 23 initially results in corresponding movement of the cam follower slide 22, the cam follower spring 41 is substantially stiffer than the throttle valve return spring 44. By way of example, a cam follower spring having a stiffness of two and one-half times the stiffness of the throttle return spring can be employed.

The engine apparatus 10 operates as follows. As the timer plate 13 rotates in accordance with desired engine speed changes, the throttle controlling cam 14 is also rotated and as the cam follower engaging the cam surface 16 encounters the portion of rapidly increasing radius, the cam follower is displaced radially outwardly relative to the center of rotation of the timer plate 13. Because the cam follower spring 41 is substantially stiffer than the throttle return spring 44, initial displacement of the cam follower 23 causes the throttle return spring 44 to compress before the cam follower spring 41. Accordingly, as the cam follower 23 is displaced by the cam 14, the cam follower slide 22 is outwardly displaced relative to the cam follower slide ramp 24 along the predetermined path with the result that the bell crank 27 is rotated around its pivot 28 and with the further result that the throttle valve 18 is displaced toward the fully open position.

Figure 3:
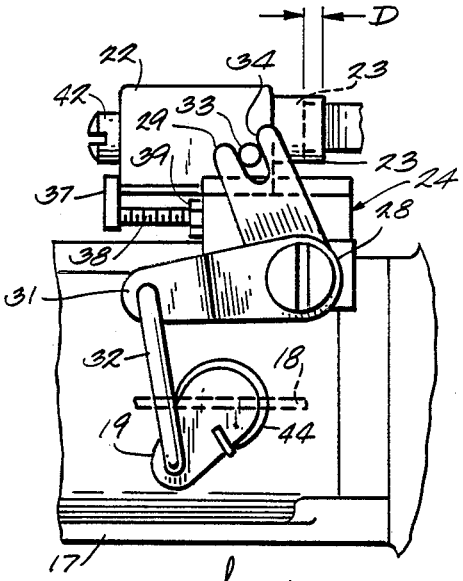
FIG. 3 is another side-elevational view of the engine apparatus showing a throttle valve in a substantially wide-open position.

Upon continued outward displacement of the cam follower slide 22, the cam follower slide 22 will eventually engage the throttle stop 36 with the result that further outward displacement of the cam follower slide beyond the fixed stop position is prevented. Through suitable adjustment of the throttle stop 36 position, the cam follower slide 22 can be stopped at a position corresponding to the throttle valve 18 being in a fully open position or, if desired, any other desired throttle valve limit position. In the event the throttle controlling cam 14 urges continued outward displacement of the cam follower 23 despite the cam follower slide 22 engaging the throttle stop 36, the cam follower bias spring 41 will begin to compress and thereby permit movement of the cam follower 33 relative to the cam follower slide 22 over a distance D as shown in FIG. 3.

Because the cam follower slide 22 remains stationary against the throttle stop during such continued movement of the cam follower 23, no additional movement of the throttle valve 18 takes place and the throttle valve remains in the desired wide-open position regardless of continued outward movement of the cam follower 23.

At low engine speeds, wherein the throttle return spring 44 biases the cam follower slide 22 away from the throttle stop 36, the correlation of throttle valve position to engine speed, as reflected by the position of the throttle controlling cam 14, can be adjusted through adjustment of the cam follower adjusting screw 42.

Preferably, each of the parts of the throttle control assembly, with the exception of the springs, is economically formed of molded plastic. No additional machining is required, and, because provision for adjustment is included, the throttle control assembly is not only well suited for use in new engines but can also be retrofitted into existing engines to cure poor performance resulting from over-center operation of the throttle valve.

Various other features and advantages of the invention are set forth in the following claims.

I claim:

1. An engine apparatus comprising an internal combustion engine, a cam movable in response to desired engine speed changes, a throttle valve movable between a closed position and an open position for regulating the flow of combustion air to said engine, and a throttle control assembly responsive to movement of said cam for controlling the position of said throttle valve in accordance with said desired engine speed changes, said throttle control assembly comprising a cam follower for engaging the cam, a cam follower slide supporting said cam follower, a cam follower slide ramp having means on said slide ramp for supporting said cam follower slide in position for engagement of said cam follower with said cam and for movement of said cam follower slide along a predetermined path in response to movement of said cam follower incident to movement of said cam, a linkage assembly coupling said cam follower slide with said throttle valve so as to vary the position of said throttle valve in accordance with the position of said cam follower slide along said predetermined path, a throttle stop for preventing movement of said cam follower slide in one direction along said predetermined path beyond a position corresponding to said open position of said throttle valve, and means for providing relative movement between said cam follower and said cam follower slide when said cam follower slide is in said position and said cam causes continued movement in said one direction of said cam follower, whereby movement of said throttle valve beyond said open position is prevented despite continued movement of said cam in accordance with further desired change in engine speed.

2. An engine apparatus in accordance with claim 1 wherein said relative movement means includes means for adjustably limiting movement of said cam follower relative to said cam follower slide in the direction opposite said one direction.

3. An engine apparatus in accordance with claim 1 wherein said cam follower is slidably mounted on said cam follower slide and wherein said relative movement means includes a first spring biasing said cam follower toward said cam.

4. An engine apparatus in accordance with claim 3 further comprising a second spring for biasing said throttle toward said closed position such that said cam follower is continuously biased against said cam.

5. An engine apparatus in accordance with claim 4 wherein said first spring provides a first bias force and said second spring provides a second bias force which is less than said first bias force such that movement of said cam so as to open said throttle compresses said second spring while said first spring remains substantially uncompressed until such time as said throttle stop prevents further movement of said cam follower slide and said cam causes continued movement of said cam follower.

6. A throttle control assembly for positioning the throttle valve of an internal combustion engine of the type including a cam movable in accordance with desired engine speed changes, said throttle control assembly comprising means coupled to the throttle valve and including a member adapted for coupling to said cam for opening the throttle valve in response to movement of said member in a first direction and for closing the throttle valve in response to movement of said member in a second direction, and lost movement means for preventing continued opening of the throttle valve beyond a predetermined position despite continued movement of said member in said first direction.

7. A throttle control assembly in accordance with claim 6 wherein said member includes a cam follower for engaging the cam and a cam follower slide for supporting the cam follower in engagement with the cam.

8. A throttle control assembly in accordance with claim 7 wherein said lost movement means permits relative movement between said cam follower and said cam follower slide.

9. A throttle control assembly in accordance with claim 8 wherein said lost movement means includes a first spring for biasing said cam follower relative to said cam follower slide.

10. A throttle control assembly in accordance with claim 9, wherein an additional spring is provided for biasing the throttle valve in a direction tending to close the throttle valve and wherein said additional spring is more easily compressed than said first spring such that said additional spring compresses before said first spring in response to movement of said member in said first direction.

11. A throttle control assembly for positioning the throttle valve of an internal combustion engine of the type including a cam movable in accordance with desired engine speed changes, said throttle control assembly comprising means adapted for coupling to the throttle valve and including apparatus having first and second members and being adapted for coupling to said cam for opening the throttle valve in response to movement of said apparatus in a first direction and for closing the throttle valve in response to movement of said apparatus in a second direction, and relative movement means for preventing continued movement of said apparatus in said first direction beyond a predetermined position despite continued movement of said first member in said first direction.

12. A throttle control assembly in accordance with claim 11 wherein said first member comprises a cam follower for engaging the cam and said second member comprises a cam follower slide for supporting the cam follower in engagement with the cam.

13. A throttle control assembly in accordance with claim 12 wherein said relative movement means permits relative movement between said cam follower and said cam follower slide.

14. A throttle control assembly in accordance with claim 13 wherein said relative movement means includes a spring biasing said cam follower relative to said cam follower slide.

15. A throttle control assembly in accordance with claim 14 wherein an additional spring is provided biasing the throttle valve in a direction tending to close the throttle valve and wherein said additional spring is more easily compressed than said first spring such that said additional spring compresses before said first spring in response to movement of said cam follower slide in said first direction.

16. A throttle control assembly for positioning the throttle valve of an internal combustion engine of the type having a mechanism for advancing and retarding ignition timing in accordance with desired engine speed changes and including a cam movable in accordance with the desired engine speed changes, said throttle control comprising means including a cam follower slide and a cam follower carried by said cam follower slide for translating movement of the cam into movement of said cam follower slide, linkage means coupling said cam follower slide and adapted to be coupled with the throttle valve to vary the position of the throttle valve in accordance with position of said cam follower slide, stop means for preventing movement of said cam follower slide beyond a predetermined stop position, and relative movement means for permitting relative movement between said cam follower and said cam follower slide when said cam follower slide is displaced to said stop position by said stop means and the cam urges further displacement of said cam follower such that movement of the linkage means beyond a desired limit position is prevented despite continued movement of the cam.

17. A throttle control assembly in accordance with claim 16 wherein said throttle stop means is adjustable so as to vary said stop position and thereby vary the desired limit position of said linkage means.

18. A throttle control assembly in accordance with claim 17 wherein said cam follower is biased into a fixed position relative to said cam follower slide when said cam follower slide is other than in said stop position and wherein adjusting means is provided for adjusting said fixed position of said cam follower relative to said cam follower slide when said cam follower slide is other than in said stop position.

19. A throttle control assembly in accordance with claim 18 wherein said desired limit position of said linkage means corresponds to the wide-open position of said throttle valve.

20. An engine apparatus comprising an internal combustion engine, a cam movable in response to desired engine speed changes, a throttle valve movable between a closed position and an open position for regulating the flow of combustion air to said engine, and a throttle control assembly responsive to movement of said cam for controlling the position of said throttle valve in accordance with desired engine speed changes, said throttle control assembly comprising a cam follower for engaging the cam, a support having means thereon for supporting said cam follower in position for engagement with said cam and for movement of said cam follower along a predetermined linear path in response to movement of said cam, and a linkage assembly coupling said cam follower with said throttle valve so as to vary the position of said throttle valve in accordance with the position of said cam follower.

21. A throttle control assembly for positioning the throttle valve of an internal combustion engine of the type including a cam movable in accordance with desired engine speed changes, said control assembly comprising a cam follower for engaging the cam, a support having means thereon for supporting said cam follower in position for engagement of said cam follower with said cam and for movement of said cam follower along a predetermined linear path in response to movement of said cam, and a linkage assembly coupling said cam follower with said throttle valve so as to vary the position of said throttle valve in accordance with the position of said cam follower.

* * * * *